United States Patent [19]

Lord

[11] Patent Number: 4,777,698

[45] Date of Patent: Oct. 18, 1988

[54] SLEEVE FOR HOLDING DOOR CLOSER

[76] Inventor: Gilles D. Lord, 4236, 41st Street, Montreal, Quebec, Canada, H1Z 1S6

[21] Appl. No.: 90,464

[22] Filed: Aug. 28, 1987

[30] Foreign Application Priority Data

Sep. 25, 1986 [GB] United Kingdom ..... 8623027

[51] Int. Cl.[4] ..... E05F 3/22

[52] U.S. Cl. ..... 16/66; 16/49; 16/DIG. 17

[58] Field of Search ..... 16/49, 51, 58, 66, 82, 16/84, DIG. 17

[56] References Cited

U.S. PATENT DOCUMENTS

| | | | |
|---|---|---|---|
| 3,162,889 | 12/1964 | Runnels | 16/82 |
| 3,566,435 | 3/1971 | Nakamura | 16/66 |
| 3,708,825 | 1/1973 | Wood | 16/66 |
| 4,194,264 | 3/1980 | Stoffregen | 16/84 |
| 4,483,044 | 11/1984 | Johnston et al. | 16/DIG. 17 |

*Primary Examiner*—M. Jordan

*Attorney, Agent, or Firm*—Roland L. Morneau

[57] ABSTRACT

A sleeve for assisting a cylindrical door closure for maintaining a door opened. A door closure made of a cylindrical barrel with a rod slidably mounted in the member is known to have a hold open washer for locking the rod relative to the barrel. The locking takes place when the washer is tilted on the rod and the edge around the hole pries on the rod. When the hole in the washer does not perform its locking function, the new sleeve is mounted over the end of the barrel. The sleeve has an end wall which abuts against the end of the barrel and is provided with a central aperture for allowing the sliding of the rod. The end wall is made with a greater thickness around the periphery to increase the angle between the washer and the rod so that the prying effect takes place between the washer and the rod.

8 Claims, 1 Drawing Sheet

SLEEVE FOR HOLDING DOOR CLOSER

BACKGROUND OF THE INVENTION

1. Field of the Invention

This invention is directed to a sleeve adapted to assist in maintaining a door opened by means of a pneumatic cylinder or spring actuated cylinder of the check type. Such cylinder requires a hold open washer to abut against the cylinder to keep the door opened in a desired angular position. After a certain amount of use, the washer does not perform satisfactorily. The washer needs to be replace and sometimes the whole door closure is replaced. The novel sleeve is mounted on the cylinder and assists the existing washer to keep performing its function.

2. Prior Art

No patent of equivalent structure and function has been located.

U.S. Pat. No. 2,703,907 discloses a laterally removable U-shaped member stradling the rod adapted to slide inside the cylinder of the door closure. The function of this member is to hold the spring of the closure under a predetermined amount of compression only until the door closure has been installed. This member is not intended to maintain the door at various angular positions and is not adapted to straddle the cylinder.

BRIEF SUMMARY OF THE INVENTION

The sleeve according to the invention is cylindrical and is adapted to straddle the end of the barrel of a cylindrical door closure. The sleeve has a end wall which is intended to abut against the end of the barrel.

The end wall is provided with an aperture sufficiently large to allow part of the hold-open washer of the closure to contact the end of the barrel and sufficiently small to provide an abutment for a lip angularly extending on the periphery of the washer. The sleeve is provided with an axial slot across its periphery and across the end wall.

Another embodiment has a end wall with a central aperture which allows only the sliding of the rod in the barrel. In this embodiment, the thickness of the wall is greater around the periphery than closer to the aperture for increasing the angle of the washer relative to the rod when the washer abuts against the wall of the sleeve.

DETAILED DESCRIPTION OF THE INVENTION

Figure 1:
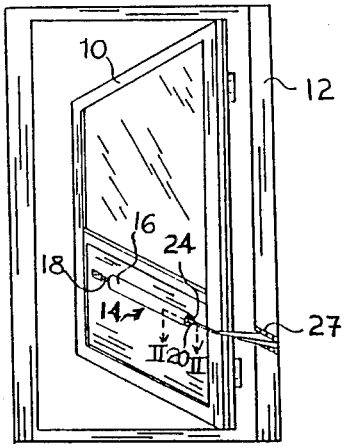
FIG. 1 is a schematic view of a door frame and a door held partly opened by a pneumatic door closure.
Figure 3:
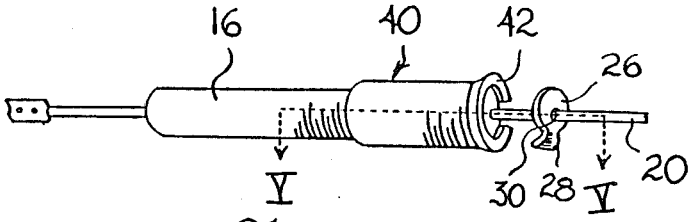
FIG. 3 is a perspective view of a door closure on which is mounted a sleeve according to the invention.

FIG. 1 illustrates the environment in which the novel sleeve is used. A door 10 is hingely mounted on a door frame 12 and is held partly opened by a door closure 14 of a known type. The door closure comprises a barrel 16 held to the door 10 by a bracket 18. The barrel 16 is of the spring or pneumatic type which incudes a mechanism adapted to axially retract the rod 20 towards the inside of the barrel. The external end of the rod 20 is secured to a bracket 22 fixed to the frame 12. This type of door closure is particularly used on aluminum door and has an average pulling power of 30 lbs to close the door. When the door 10 is opened, the rod 20 slides out of the barrel 16 and may be locked in any intermediate position by a hold-open washer 24. As seen in FIG. 3 the washer 24 is made of a generally circular ring 26 which has a lip 28 angularly oriented on its periphery. The washer 24 has an inner circular aperture 30 which is slightly larger than the cross-section of the rod 20.

Figure 2:
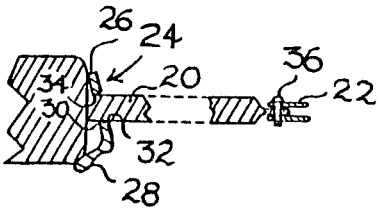
FIG. 2 is a cross-sectional view of the door closure taken along line II—II of FIG. 1.

The hold-open washer 24 locks the rod 20 in an intermediate position in a manner illustrated in FIG. 2. Although the circular aperture 30 is slightly larger than the size of the rod 20, the edges 32 and 34 of the tilted washer 24 squeeze the rod 20 when the washer 24 is pushed against the end of the barrel 16 because the angular lip causes the tilting of the washer. The prying of the washer is maintained by the retraction power of the rod 20. This characterized the normal operation of the door closure 14.

When the door closure has been used for a more or less long period, the edges 32 and 34 become warn out and the aperture 30 is too large to maintain the retention of the rod 20.

Even before the washer 24 is completely useless, it may be unsecured in many circumstances to go through an opened door which may close at the slightest touch.

The obvious cure is the substitution of a new washer 24 but this is not an easy operation. As seen in FIG. 2, one must remove the screw or pin 36 connecting the rod 20 to the bracket 22 and substitute a new washer. Reconnecting the rod 20 to the bracket 22 is difficult because the rod 20 tends to retract in the barrel 16 and it takes about a force of 30 lbs to pull it out while one has to align the rod 20 and the bracket 22 to introduce the screw 36 in its socket.

Figure 4:
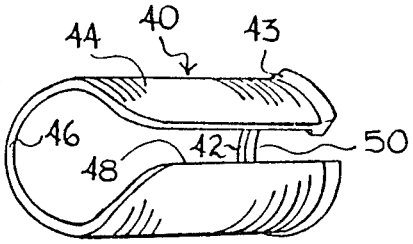
FIG. 4 is a perspective view of a sleeve according to the invention and, FIG. 5 is a cross-sectional view of the door closure and the sleeve taken along line V—V of FIG. 3 with the hold-open washer in contact with the sleeve.

The sleeve according to the present invention eliminates this operation while making use of the original washer. The sleeve 40 shown in FIG. 3 is monted over the end of the barrel 16. The end wall 42 of the sleeve abuts against the end of the barrel 16 and is located between the latter and the washer 24. The sleeve 40 shown in FIG. 4 is made of a cylindrical member 44 opened at one end 46 and partially closed at the other end by a substantially flat ring shaped end wall 42. The cylindrical member 44 is provided with axial slot 48 on its periphery and across the end wall 42. This slot 48 allows the sleeve 40 to be slipped over the rod 20. Afterwards, the sleeve is slidden over the barrel 16. This completes the operation relative to the installation of the sleeve which is simple compare to the substitution of a new washer. The slot 48 is widen at the rear end of the sleeve to serve as a guiding means for the introduction of the rod 20 through the slot.

Figure 5:
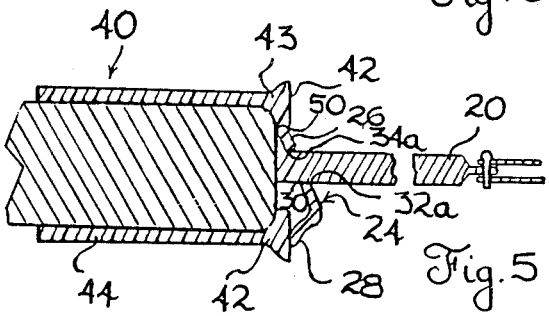

The function of the sleeve is particularly illustrated in FIG. 5. When the washer 24 is pushed against the sleeve 40, the upper portion of the ring 26 falls inside the aperture 50 of the end wall 42 and abuts against the end of the barrel 16. The aperture 50 is made slightly larger than the contour of the ring 26 for that purpose. However, the angular lip 28 of the washer 24 abuts against the end wall 42 which acts as a shoulder and which increases the angle of the washer 24 relative to the end of the barrel 16. This causes the edges 32a and 34a of the aperture 30 which have been warn, to firmly contact the rod 20 and grip it to prevent the latter from retracting inside the barrel 16. A circular bead 43 may be added around the end wall 42 to provide and adequate shoulder to the lip 28 which extends outside the periphery of the cylindrical member 44.

Considering that the retraction power of the rod 20 is about 30 lbs, this means that the lip 28 abuts quite firmly against the outer edge of the end wall 42. This leaverage action could force the sleeve 40 to slip out of the barrel 16 considering that the sleeve 40 saddles the barrel 16 on account of the slot 48. This slipperage is overcome by increasing the length of sleeve 40. The barrel 16 usually has a diameter of 1¼ in. or 1½ in. The slot 48 also allows the use of the same size sleeve over both diameter when the sleeve is made of a resilient plastic such as high density polyethylene. Such plastic tolerates all cold and hot temperatures expected in the operation of doors while retaining its desired characteristics.

In actual construction, a sleeve has a length of about one to three inches, an inner diameter of slightly less than 1¼ in. and an overall thickness of at least 1/16 in. and preferably ⅛ in. The sleeve may be made of high density polyethylene which performs with complete satisfaction. Because the lip 28 usually extends beyong the diameter of the barrel, it is advantageous to increase the diameter of the end wall with a triangular bead 43. The bead and the fact that the material is a plastic provide a resiliency to the abutment of the lip 28. This resiliency prevents the door from closing when the door is slightly unintentionally touched.

Figure 6:
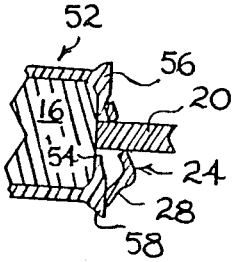
FIG. 6 is a cross-sectional view of another embodiment of the sleeve as shown in FIG. 5.

It is essential purpose of the sleeve to increase the angular position of the hold-open washer on the rod. This result could also be achieved by a sleeve 52 such as illustrated in figure 6. The sleeve 52 has an opening 54 which only allows the rod 20 to slide therethrough. The washer 24 abuts completely against the end wall 56 of the sleeve 52. However, the periphery 58 of the end wall 56 is thicker at 58 which produces the increase of the angle of the washer 24 relative to the rod 20. The same purpose could be achieved by glueing a ring equivalent to one of the end wall described above at the end of the barrel 16 but it has been found that glue could not provide a satisfactory grip between the barrel and such a ring, because the leverage force of the lip 28 on the periphery of the ring is too great. It is therefore a purpose of the cylindrical member such as 44 to maintain such ring which is the end wall 56 or 42 in the desired position.

It should be understood that this invention is directed to a sleeve per se although its description need to relate to a door closer. In fact, the sleeve is sold as a separate item and is used when the door closure and in particular the hold open washer cease to operate satisfactorily by itself.

I claim:

1. A sleeve adapted to fit over a cylindrical door closure for maintaining a door in an opened position the said closure comprising a barrel, a rod slidably mounted in said barrel and a hold open washer loosely mounted on said rod, the said washer being provided with a lip extending angularly on its periphery, the said washer adapted to abut against said barrel at an angular position to lock said rod relative to said barrel, the said sleeve being provided at one end with a wall forming an internal shoulder sufficient to allow the sleeve to abut against said barrel, said internal shoulder leaving a central opening larger than the size of said washer, the thickness of said wall providing a shoulder for said lip sufficient to increase the said angular position of the said washer on said rod relative to the said barrel.

2. A sleeve as recited in claim 1, wherein the said sleeve is made of resilient polyethylene plastic of high density.

3. A sleeve as recited in claim 1, having a length between one and three inches and an overall thickness of between 1/16 and ⅛ in.

4. A sleeve adapted to be mounted on a door closure installed between a door and a door frame, the said door closure having a barrel, a rod slidably mounted on the axis of said barrel and extending partly outside the latter, means inside said barrel for pulling said rod partly inside said barrel, a ring-type washer loosely mounted on said rod and adapted to be angularly positioned on said rod, a lip angularly extending on the outer periphery of said washer, the said lip adapted to abut against the outer end of the barrel, the said washer adapted to abut against the end of said barrel at an angular position to lock said rod relation to said barrel, the sleeve being characterized by a cylidrical member adapted to be firmly mounted over the end of said barrel, the said sleeve having a substantially flat end wall for providing a peripheral abutment for said cylindrical member at the end of said barrel, the said wall being provided with a central opening for allowing the sliding of the said axial rod, and allowing the washer to contact the said end of the said barrel, the said wall having a diameter for providing a shoulder for the said lip when the washer is axially positioned in the said rod for locking the latter relative to the said barrel.

5. A sleeve as recited in claim 4, wherein the cylindrical member is provided with a longitudinal slot along the whole length of the said member and extending to the said central opening.

6. A sleeve as recited in claim 4, wherein the outer periphery of said end wall comprises a circular bead larger than the diameter of said cylindrical member.

7. A sleeve as recited in claim 4, wherein the said end wall has a thickness of at least 1/16 of an inch.

8. A sleeve adapted to be mounted on a cylindrical door closer for maintaining a door in an opened position, the said sleeve comprising a cylindrical member and adapted to frictionally fit over said cylindrical door closure and a wall at one end of said sleeve adapted to abut against the end of said cylindrical door closure, the said wall being provided with a centrally located aperture, the said cylindrical member and said wall being provided with a longitudinal slot along the whole length of said sleeve, the said wall being thicker at its periphery.

* * * * *